US010704127B2

(12) United States Patent
Palitsch et al.

(10) Patent No.: US 10,704,127 B2
(45) Date of Patent: Jul. 7, 2020

(54) METHOD OF FORMING ALUMINUM ALLOY AIRFOILS

(71) Applicant: United Technologies Corporation, Farmington, CT (US)

(72) Inventors: John Richard Palitsch, Vernon, CT (US); James O. Hansen, Glastonbury, CT (US); Nicolas Figueiredo, Bolton, CT (US); Daniel Gynther, Marlborough, CT (US); Stephen E. Graushinsky, Broad Brook, CT (US); John H. Nortrup, Vernon, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 959 days.

(21) Appl. No.: 15/075,795

(22) Filed: Mar. 21, 2016

(65) Prior Publication Data

US 2017/0268087 A1 Sep. 21, 2017

(51) Int. Cl.

| | |
|---|---|
| ***C22F 1/04*** | (2006.01) |
| ***B21H 7/16*** | (2006.01) |
| ***F01D 5/28*** | (2006.01) |
| ***F01D 5/30*** | (2006.01) |

(52) U.S. Cl.

CPC ..... *C22F 1/04* (2013.01); *B21H 7/16* (2013.01); *F01D 5/28* (2013.01); *F01D 5/30* (2013.01); *F05D 2220/32* (2013.01); *F05D 2230/20* (2013.01); *F05D 2230/90* (2013.01); *F05D 2300/173* (2013.01)

(58) Field of Classification Search

CPC ..... B21H 7/16; C22F 1/04

See application file for complete search history.

(56) References Cited

U.S. PATENT DOCUMENTS 4,048,836 A * 9/1977 Eddy ..... B21J 1/06 148/577
4,616,499 A * 10/1986 Gray ..... C22F 1/04 72/364
5,108,519 A * 4/1992 Armanie ..... C22C 21/00 148/439

(Continued)

FOREIGN PATENT DOCUMENTS

EP 2633942 A2 9/2013

OTHER PUBLICATIONS

Altan, Taylan Ngaile, Gracious Shen, Gangshu. (2004). Cold and Hot Forging—Fundamentals and Applications. ASM International. (Year: 2004).*

(Continued)

*Primary Examiner* — Colleen P Dunn
*Assistant Examiner* — Jeremy C Jones
(74) *Attorney, Agent, or Firm* — Cantor Colburn LLP

(57) ABSTRACT

A method of forming an airfoil includes placing a material onto a die that is heated to a predetermined temperature to pre-heat the material to a first temperature, while the die is in an open position. The method further includes closing the die at a predetermined rate and holding the die in a closed position for a predetermined period of time at a first force. The method still further includes removing the part from the die, cooling the die, placing the part onto the die, and closing the die at a second force.

18 Claims, 2 Drawing Sheets

(56) References Cited

U.S. PATENT DOCUMENTS

| | | | | |
|---|---|---|---|---|
| 2002/0062941 | A1* | 5/2002 | Cowie | B22D 17/24 164/103 |
| 2012/0152416 | A1* | 6/2012 | Foster | C22F 1/00 148/695 |
| 2013/0125606 | A1* | 5/2013 | Lin | C22C 21/00 72/364 |
| 2013/0195674 | A1 | 8/2013 | Watson et al. | |
| 2015/0013144 | A1 | 1/2015 | Bush et al. | |
| 2016/0108505 | A1* | 4/2016 | Fujii | B21K 1/36 29/889.7 |

OTHER PUBLICATIONS

ASM International Handbook Committee. (1991). ASM Handbook, vol. 04—Heat Treating—7.3.11 Press Quenching. ASM International. (Year: 1991).*

European Search Report for European Patent Application 17162173.3 dated Nov. 27, 2017, 5 pages.

* cited by examiner

METHOD OF FORMING ALUMINUM ALLOY AIRFOILS

BACKGROUND

The present disclosure relates to a method of forming aluminum alloy airfoils.

Gas turbine engines are commonly provided with formed airfoils. The formed airfoils are made of a thin material. The thin material presents challenges in forming the airfoil.

BRIEF DESCRIPTION

According to an embodiment of the present disclosure, a method of forming an airfoil is provided. The method includes placing a material onto a die that is heated to a predetermined temperature to pre-heat the material to a first temperature, while the die is in an open position. The method further includes closing the die at a predetermined rate and holding the die in a closed position for a predetermined period of time at a first force. The method still further includes removing the part from the die, cooling the die, placing the part onto the die, and closing the die at a second force.

According to another embodiment of the present disclosure, a method of forming an aluminum alloy airfoil is provided. The method includes placing an aluminum alloy material onto a heated die having position locators configured to locate the aluminum alloy material relative to a die shape within the heated die. The heated die is maintained in an open position for the first predetermined period of time to heat the aluminum alloy material to a predetermined temperature. The method further includes closing the heated die at a predetermined rate after the aluminum alloy material achieves the predetermined temperature and holding the heated die in a closed position for a second predetermined period of time to form a part made of a formed aluminum alloy material.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Referring now to the Figures, where the present disclosure will be described with reference to specific embodiments, without limiting same, it is to be understood that the disclosed embodiments are merely illustrative of the present disclosure that may be embodied in various and alternative forms. Various elements of the disclosed embodiments may be combined or omitted to form further embodiments of the present disclosure. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Gas turbine engines are commonly provided with airfoils. The airfoils are inserted into a hub and the airfoils extend radially outward from the hub. The airfoils are formed of metallic alloys, such as an aluminum alloy, having a thin material thickness. Traditional methods to form the airfoil from the aluminum alloy generally involve cold forming the material into the desired airfoil shape. The cold forming process sometimes requires additional hand work to produce the desired tolerances. The additional hand work may produce inconsistency in the final product and present repeatability challenges.

Figure 1:
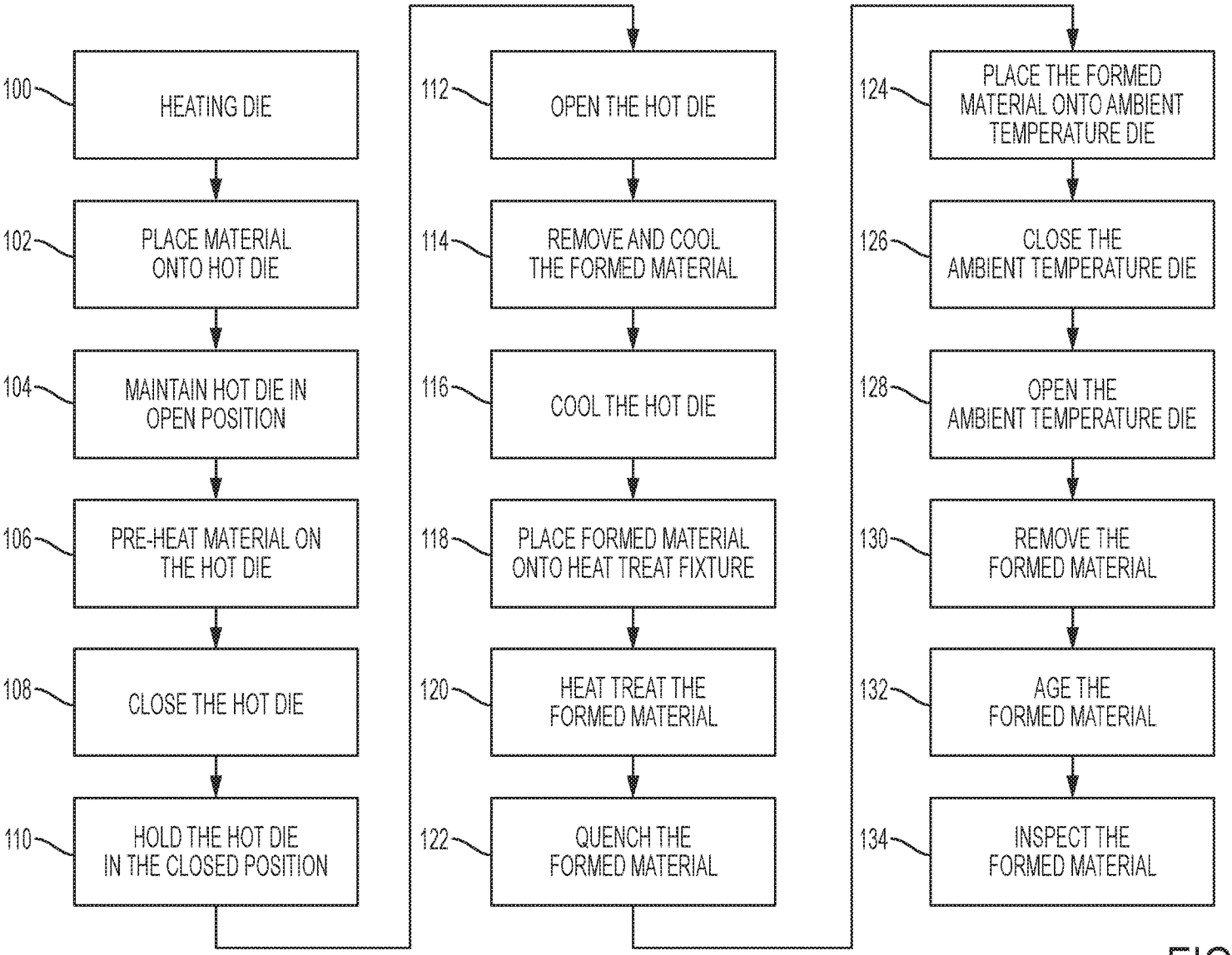
FIG. 1 is a flowchart illustrating a method of forming an aluminum alloy airfoil.

Airfoils generally do not possess a flat surface, but instead include twisted surfaces or non-flat surfaces that are difficult to form. The formation of such surfaces using traditional forming methods presents residual stresses and dimensional challenges. Referring to FIG. 1 a flowchart illustrating a method of forming an aluminum alloy airfoil to alleviate such residual stresses and dimensional challenges is shown.

Figure 2:
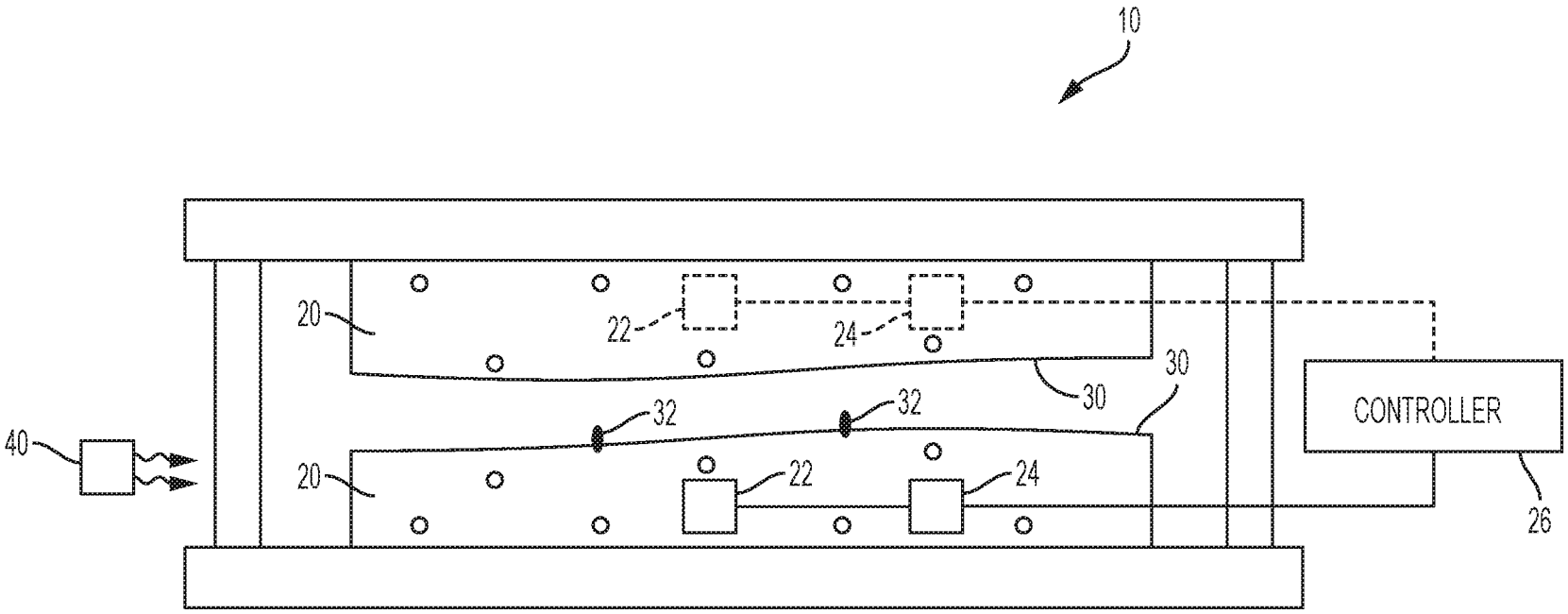
FIG. 2 is a view of a die configured to form an aluminum alloy airfoil.

The method of forming the aluminum alloy airfoil includes the use of a die unit 10, as illustrated in FIG. 2. The die unit 10 is configured as a die press. The die unit 10 includes a pair of die plates 20, at least one heating element 22, at least one thermocouple 24, and a controller 26 in communication with the at least one heating element 22 and the at least one thermocouple 24. The die plates 20 are movable between an open position and a closed position. At least one of the die plates 20 is provided with a die shape 30 to form an aluminum alloy material into a desired airfoil shape. The aluminum alloy material is a precipitation hardenable aluminum alloy. In at least one embodiment, a titanium alloy, a steel alloy, a nickel alloy, or the like may be used.

The die plates 20 include at least one positioning locator 32. The at least one positioning locator 32 locate the aluminum alloy material relative to the die shape 30 when the aluminum alloy material is inserted between the die plates 20. The at least one positioning locator 32 are configured as fingers or protrusions that extend from a surface of at least one of the die plates 20. The die plates 21 of the die unit 10 are designed to have different lengths such that the positioning locators 32 do not engage each other.

The at least one heating element 22 is disposed within at least one of the pair of die plates 20. The at least one heating element 22 may be a resistive heating element or the like that is configured to heat at least one of the die plates 20 to a predetermined temperature. The predetermined temperature may be within the range of 700° F. to 900° F. The at least one thermocouple 24 is disposed within at least one of the pair of die plates 20. In at least one embodiment, the at least one thermocouple 24 is disposed proximate the at least one heating element 22. The at least one thermocouple 24 is configured to measure a temperature of at least one of the die plates 20.

In at least one embodiment, a forced air cooler 40 is provided. The forced air cooler 40 is disposed proximate the die unit 10 adjacent to at least one of the die plates 20. The forced air cooler 40 is configured to provide forced ambient air to cool at least one of the die plates 20 to a temperature less than the predetermined temperature, such as an ambient temperature may be within the range of 65° F. to 80° F.

Referring to FIG. 1, at block 100, at least one of the die plates 20 is heated by the at least one heating element 22 to the predetermined temperature such that the die unit 10 is considered a heated die. To heat at least one of the die plates 20, the controller 26 commands that a current or voltage be provided to the at least one heating element 22 from a power source.

At block 102, the aluminum alloy material is placed onto the heated die. The aluminum alloy material is placed onto at least one of the die plates 20 relative to the at least one positioning locator 32 that are disposed relative to the die shape 30. The die unit 10 is maintained in an open position such that each of the die plates 20 are spaced apart from each other, at block 104. In at least one embodiment, the die unit is closed such that a top die plate makes contact with the aluminum alloy material.

The heated die heats or pre-heats the aluminum alloy material to a first temperature for a first predetermined period of time, for example approximately one minute, at block 106. The first temperature is measured by the at least one thermocouple 24 or another temperature measurement device disposed proximate the aluminum alloy material. The first temperature is a predetermined temperature greater than a warm forming temperature. Warm forming temperatures are generally within the range of 500° F. to 525° F. In at least one embodiment, the first temperature is a temperature proximate the predetermined temperature of the hot die.

At block 108, the heated die is closed such that the die plates 20 move from the open position towards the closed position. The heated die is closed at a predetermined rate after the aluminum alloy material achieves the first temperature until the die plates 20 are completely closed. For example, the die plates 20 are closed to slowly creep form the aluminum alloy material at a predetermined rate such that the die plates 20 achieve the closed position after two and a half minutes. The heated die is closed to deform the aluminum alloy material. The predetermined rate is a constant speed, incremental movements, or progressive movements.

At block 110, the heated die is held in the closed position. The heated die is held in the closed position for a second predetermined period of time, for example three to ten minutes, at a first force to creep form the aluminum alloy material to conform to the die shape 30. The die shape 30 forms a part that is made of a formed aluminum alloy material.

At block 112, the heated die is opened such that the die plates 20 move from the closed position towards the open position. In at least one embodiment, the controller 26 continues to provide current or voltage to the at least one heating element 22. In at least one embodiment, the controller 26 ceases the provision of current or voltage from the power source to the at least one heating element 22 in response to a command to open the die unit 10. In at least one embodiment, the controller 26 ceases the provision of current or voltage from power source to the at least one heating element 22 in response to the die unit 10 achieving or moving towards the open position.

At block 114, the part made of the formed aluminum alloy material is removed from the die unit 10. The part made of the formed aluminum alloy material is removed to be cooled at an ambient temperature. The part made of the formed aluminum alloy material is cooled to a temperature proximate the ambient air temperature.

At block 116, the die plates 20 of the heated die is cooled by ambient air to the ambient temperature. The heated die is cooled such that at least one of the die plates 20 achieves the ambient air temperature. The heated die may be cooled by forced air to the ambient air temperature by the forced air cooler 40.

At block 118, the part made of the formed aluminum metal material is placed onto a heat treat fixture. The heat treat fixture includes controlled contours. The controlled contours may have a shape substantially similar to the shape of the part made of the formed aluminum alloy material. The controlled contours maintain or adjust the shape of the part made of the formed aluminum alloy material.

At block 120, the heat treat fixture and the part made of the formed aluminum alloy material are heat treated. The heat treat fixture and the part made of the formed aluminum alloy material are placed into an oven. The oven is heated to a second temperature prior to placing the heat treat fixture and the part made of the formed aluminum alloy material into the oven. The second temperature may be greater than the first temperature. The second temperature is a predetermined aluminum alloy material solution temperature that is within the range of 870° F. to 940° F. The heat treat fixture and the part made of the formed aluminum alloy material are held in the oven for a predetermined period of time, for example three to ten minutes.

At block 122, the heat treat fixture and the part made of the formed aluminum alloy material are quenched at a predetermined immersion rate. The heat treat fixture and the part made of the formed aluminum alloy material are quenched in a water bath or a water and glycol mixture bath. The water and glycol mixture bath may include glycol up to and including 40% of the bath volume. The quenching of the part made of the formed aluminum alloy material within the water and glycol mixture bath reduces distortion of the part made of the formed aluminum alloy material. The part made of the formed aluminum alloy material is quenched until the part temperature becomes below 85° F. In at least one embodiment, the part made of the formed aluminum alloy material is quenched for approximately one to two minutes.

Subsequent to the quenching of the part made of the formed aluminum alloy material, the part made of the formed aluminum alloy material may be chilled. The part made of the formed aluminum alloy material may be placed on ice or in a freezer to cool the part made of the formed aluminum alloy material to a third temperature. The third temperature is less than the first temperature. In at least one embodiment, the part formed of the aluminum alloy material remains on ice or in a freezer at least until the die plates 20 of the die unit 10 achieve approximately the ambient temperature.

At block 124, the part made of the formed aluminum alloy material is placed back onto at least one of the die plates 20 of the die unit 10. At least one of the die plates 20 of the die unit 10 is at an ambient temperature such that the die unit 10 is considered an ambient temperature die. The part made of the formed aluminum alloy material is placed relative to the at least one positioning locator 32 that are disposed relative to the die shape 30. In at least one embodiment, the part made of the formed aluminum alloy material is placed in a separate die unit having die plates that are at an ambient temperature. The die plates of the separate die unit may be considered an ambient temperature die.

At block 126, the ambient temperature die is closed such that the die plates 20 move from the open position towards the closed position. The die plates 20 are closed at a predetermined rate at a second force until the die plates 20 are completely closed. The second force may be greater than the first force. The ambient temperature die is closed to cold work the part made of the formed aluminum alloy material. The predetermined rate is a constant speed, incremental movements, or progressive movements. The die plates 20 are held in the closed position for a third predetermined period of time. In at least on embodiment, the third predetermined time period is less than the second predetermined period of time.

At block 128, the ambient temperature die is opened such that die plates 20 move from the closed position towards the open position. At block 130, the part made of the formed aluminum alloy material is removed from the ambient temperature die.

At block 132, the part made of the formed aluminum alloy material is placed in a fixture and the combination of the part made of the formed aluminum alloy material and the fixture are placed in an oven for aging. The part made of the formed aluminum alloy material is artificially aged in the oven for a fourth predetermined period of time at a fourth temperature. The artificial aging process may be a two-stage the aging process where the part made of the formed aluminum alloy material is aged at a temperature within the range of 225° F. to 325° F. and is subsequently aged at a temperature within the range of 310° F. to 320° F.

At block 134, the part made of the formed aluminum alloy material is inspected. The part is inspected for conformity with dimensional tolerances.

The implementation of the method of forming an aluminum alloy airfoil reduces twist or dimensional issues of the part made of the formed aluminum alloy material. The method of forming an aluminum alloy airfoil reduces the amount of scrap and reduces the likelihood of hand working to achieve dimensional conformance. The method of forming the aluminum alloy airfoil is also cheaper than present aluminum alloy airfoil manufacturing processes.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A method of forming an airfoil, comprising:

placing a material onto a die that is heated to a predetermined temperature to pre-heat the material to a first temperature, while the die is in an open position;

closing the die at a predetermined rate;

holding the die in a closed position for a predetermined period of time at a first force to form the pre-heated material into a part;

removing the part from the die;

quenching the part by immersion;

cooling the die;

placing the part back onto the die;

and closing the die at a second force.

2. The method of claim 1, further comprising:

cooling the part at an ambient temperature following the removing of the part from the die; and heat treating the part at a second temperature for a predetermined time.

3. The method of claim 2, wherein the second temperature is greater than the first temperature.

4. The method of claim 2, further comprising:

quenching the part by following the removing of the part from the die and the heat treating of the part immersing the part at a predetermined immersion rate; and cooling the part at a third temperature at least until the die achieves approximately ambient temperature wherein the third temperature is less than the first temperature.

5. The method of claim 4, further comprising:

removing the part from the die following the placing of the part back onto the die and the closing of the die at a second force; and aging the part at a fourth temperature for another predetermined period of time, wherein the fourth temperature is less than the first temperature.

6. The method of claim 1, wherein the die is cooled by ambient air.

7. The method of claim 1, wherein the die is cooled by forced air provided by a forced air cooler disposed proximate to the die.

8. The method of claim 1, wherein the die includes a plurality of positioning locators to locate the material relative to a shape of the die.

9. The method of claim 1, wherein the die includes controller in communication with at least one thermocouple and at least one heating element that heats the die to the first temperature.

10. A method of forming an aluminum alloy airfoil, comprising:

heating a die having position locators;

placing an aluminum alloy material onto the heated die whereby the position locators are configured to locate the aluminum alloy material relative to a die shape within the heated die;

maintaining the heated die in an open position for a first predetermined period of time to heat the aluminum alloy material to a predetermined temperature;

Page 3 of 9 U.S. application Ser. No. 15/075,795 In Reply to Office Action dated Dec. 4, 2018 closing the heated die at predetermined rate after the aluminum alloy material achieves the predetermined temperature;

holding the heated die in a closed position for a second predetermined period of time to form a part made of a formed aluminum alloy material;

opening the heated die, removing the part and cooling the die to an ambient temperature;

quenching the part by immersion;

and placing the part back onto the die at the ambient temperature for executing a cold working process on the part.

11. The method of claim 10, wherein the heated die includes a controller in communication with at least one heating element and at least one thermocouple.

12. The method of claim 10, wherein the removing of the part comprises removing the part to cool the part to an ambient air temperature.

13. The method of claim 12, further comprising:

placing the part onto a heat treat fixture having controlled contours configured to maintain a shape of the part; and heating the heat treat fixture and the part to an aluminum alloy material solution temperature and time.

14. The method of claim 13, further comprising:

quenching the part by immersion at a predetermined immersion rate.

15. The method of claim 14, wherein the cold working process comprises:

closing the die at the ambient temperature; and opening the die at the ambient temperature.

16. The method of claim 15, wherein the ambient temperature is less than a heated die temperature.

17. The method of claim 15, further comprising:

aging the part made of the formed aluminum alloy material.

18. A method of forming an airfoil comprising:

placing a material onto an open die that is heated to a predetermined temperature to pre heat the material to a first temperature;

closing the die and holding the die in a closed position for a predetermined period of time at a first force to form the pre-heated material into a part;

removing the part from the die;

quenching the part by immersion;

cooling the die with forced aft;

placing the part back onto the die;

and closing the die and holding the die in the closed position for a predetermined period of time at a second force.

* * * * *